United States Patent [19]

Szott et al.

[11] 4,216,174

[45] Aug. 5, 1980

[54] METHOD AND APPARATUS FOR PREPARATION AND CONTROL OF AN AIR-FUEL MIXTURE

[75] Inventors: Ryszard Szott; Ryszard Machnowski, both of Bielsko-Biala, Poland

[73] Assignee: Osrodek Badawczo-Rozwojowy Samochodow Malolitrazowych "BOSMAL", Bielsko-Biala, Poland

[21] Appl. No.: 973,013

[22] Filed: Dec. 26, 1978

[30] Foreign Application Priority Data

Dec. 31, 1977 [PL] Poland ..... 203700

[51] Int. Cl.[2] ..... F02M 23/02

[52] U.S. Cl. ..... 261/30; 261/DIG. 51; 261/DIG. 39; 261/78 R; 123/531; 239/427.5; 239/431

[58] Field of Search ..... 261/DIG. 51, DIG. 39, 261/78 R, 30; 123/131, 33 E; 239/427.5, 430, 431, 416.1

[56] References Cited

U.S. PATENT DOCUMENTS

| | | | |
|---|---|---|---|
| 1,886,989 | 11/1932 | Trumble | 261/DIG. 51 |
| 2,012,564 | 8/1935 | Holmes | 261/DIG. 51 |
| 2,223,381 | 12/1940 | Mock | 261/DIG. 51 |
| 2,247,189 | 6/1941 | De Guyon | 261/DIG. 51 |
| 2,878,065 | 3/1959 | Watkins | 239/405 |
| 3,610,537 | 10/1971 | Nakagawa et al. | 239/419.3 |
| 3,635,201 | 1/1972 | High | 123/131 |
| 3,764,069 | 10/1973 | Runstadler, Jr. et al. | 239/431 |
| 3,790,086 | 2/1974 | Masai | 239/426 |
| 4,084,934 | 4/1978 | Kumazawa | 239/427.5 |
| 4,159,014 | 6/1979 | Szott et al. | 123/119 A |

FOREIGN PATENT DOCUMENTS

| | | | |
|---|---|---|---|
| 1089994 | 10/1954 | France | 123/131 |

*Primary Examiner*—Tim R. Miles

*Attorney, Agent, or Firm*—Haseltine, Lake & Waters

[57] ABSTRACT

A method and apparatus for the preparation and control of an air-fuel mixture in which compressed air is divided into two streams, one of which is at a pressure taking into account engine load and existing atmospheric conditions and serves for supplying and sucking fuel and its preliminary atomization, the second stream serving for successive atomizations of fuel and correction of discharge while preventing secondary coagulation. The mixture is fed to the engine intake manifold, where it is further mixed with air sucked by the engine.

11 Claims, 3 Drawing Figures

METHOD AND APPARATUS FOR PREPARATION AND CONTROL OF AN AIR-FUEL MIXTURE

FIELD OF THE INVENTION

This invention relates to a method and apparatus for the preparation and control of an air-fuel mixture for engines, particularly internal combustion engines with spark ignition.

PRIOR ART

Those skilled in the art know from the Polish patent applications Nos. P-192084, P-193026, P-19561, P-197978 and P-201371 methods and devices for the preparation and control of air-fuel mixture, as well as means for improvement of their component parts which are most relevent to the subject of this invention, both as far as the essence of the presented method and the practical solution of the problem set forth are concerned.

SUMMARY OF THE INVENTION

This invention seeks to provide a method and apparatus satisfying all the practical operational requirements relating to the problem of an economical feeding of the engines while increasing the performance of the engine and prolonging its service life, as well as reducing the amount of the toxic compounds in the exhaust gases to trace amounts: this objective is achieved by an improvement of the methods and devices known from the state of art and, particularly, by a proper design of the control system.

The essence of the method of preparation and control of the air-fuel mixture according to this invention consists in that a known source, with delivery suited to the requirements of the characteristics of the engine, produces compressed air, practically without pulsation, with a pressure dependent upon the atmospheric conditions and crankshaft speed.

This compressed air is supplied to the device, wherein it is divided into at least two streams in a definite controlled ratio, acting separately and serving different purposes, but in close interdependence and mutual cooperation with one another to obtain the best possible mixture.

One stream is provided with a known system for pressure regulation controlled by the negative pressure under the throttle and or the position of the pull rod from the accelerator pedal, and the stream serves for supply and suction of a definite amount of fuel and its initial atomization depending upon engine load, existing atmospheric conditions and the throttle position.

The second stream, which is provided with another pressure correction system by means of the required variation or momentary reduction of the effective area of the central nozzle, serves for the successive atomizations and homogenizing of the mixture as a result of interacting of the pressure air streams flowing from the successive nozzles, for the desired correction of discharge acting in feedback depending upon: the stream intensities, as well as directions and cross sectional areas of the individual nozzles in the system and the pressure ratios acting in the system due to the applied control in one stream and pressure corrections in the second stream; it is also used for elimination of secondary coagulation, preferably deflection of the mixture stream.

The pressure correction system used enables compensation of manufacturing tolerances and the degree of wear of the device, as well as an instantaneous pressure rise in order to facilitate the start of a cold engine.

Moreover, the pulsation of compressed air supplied from the air source is eliminated by means of an automatic opening of an additional port for better pressure equalization, while pulsation of pressure for control of the pneumatic actuator is eliminated by means of an appropriate throttling of the flow, whereas compressed air supplied to the float chamber is preferably taken on the upstream side of the reduced portion of the tube.

The device for the preparation and control of the air-fuel mixture according to this invention consists in that a source of compressed air with appropriately chosen delivery, preferably a displacement pump driven by the engine crankshaft and fitted with suitable pulsation elimination means, is connected by a tube directly to a device, said tube being divided into at least two passages.

In the first of the said passages, there is installed a control valve connected in conventional manner to the pneumatic actuator and accelerator pedal; said first passage narrows downstream of this control valve and is connected to side nozzles for preliminary atomization, whereas upstream of this reduced portion it is connected through a channel to the float chamber, said float chamber being, in turn, connected to the side nozzles for preliminary atomization.

The second passage is connected directly to the central nozzle of a multi-stage atomizer.

A multi-stage atomizer of conventional construction is usually located along the axis of the engine air intake upstream of the throttle, and consists of a seat located in the device, the nozzle unit being mounted on said seat and seals for separation of the compressed air flowing to the side nozzles and the compressed air flowing to the central nozzle, said nozzle unit being pressed against the bottom of the seat. The atomizer further comprises a head with a movable needle threadably and resiliently mounted for varying the effective cross sectional area of the central nozzle by rotation or for reducing the area momentarily by displacing the needle by means of a Bowden cable operated by the driver.

Moreover, the recess in the nozzle unit forming an annular chamber of the slot nozzle, when pressed against the seat, is connected through suitable holes with the side nozzles, while the passage connecting the engine air intake under the throttle to the pneumatic actuator has an appropriately reduced portion, whereas in the displacement pump body (sliding) surface there are grooves leading from the outlet channel toward the upstream side of the blades within an appropriately chosen range of angles.

Moreover, when the device according to this invention is provided with a plurality of float chambers with the necessary supplies of compressed air and with the required supplies of fuels to the individual side nozzles, this makes it possible for internal combustion engines to be supplied with multi-fuel mixtures, including fuels forming emulsions or solutions.

The method and apparatus according to this invention has the following advantages: practical applicability both for production as well as operational purposes, correct and full combustion of very lean mixtures, that is up to $\lambda=1.5$ and more with trace amounts of toxic compounds in the exhaust gases, possible fulfilment of the requirements of the California test as to the purity of the exhaust gases, proper detonation-free combustion with very high compression ratios $\epsilon=10$ and more and, at the same time, with very uniform engine running and lower thermal loads, a simple method of control of the fuel mixture and engine feeding operating automatically and taking into account the varying atmospheric conditions and depending upon the driver's operation of the accelerator pedal, as well as a simple, cheap and durable device, which ensures an increased engine torque and horse power and a smaller fuel consumption by suitable preparation of the air fuel mixture also when it is cooperating with a standard non-adapted engine.

DETAILED DESCRIPTION

Figure 1:
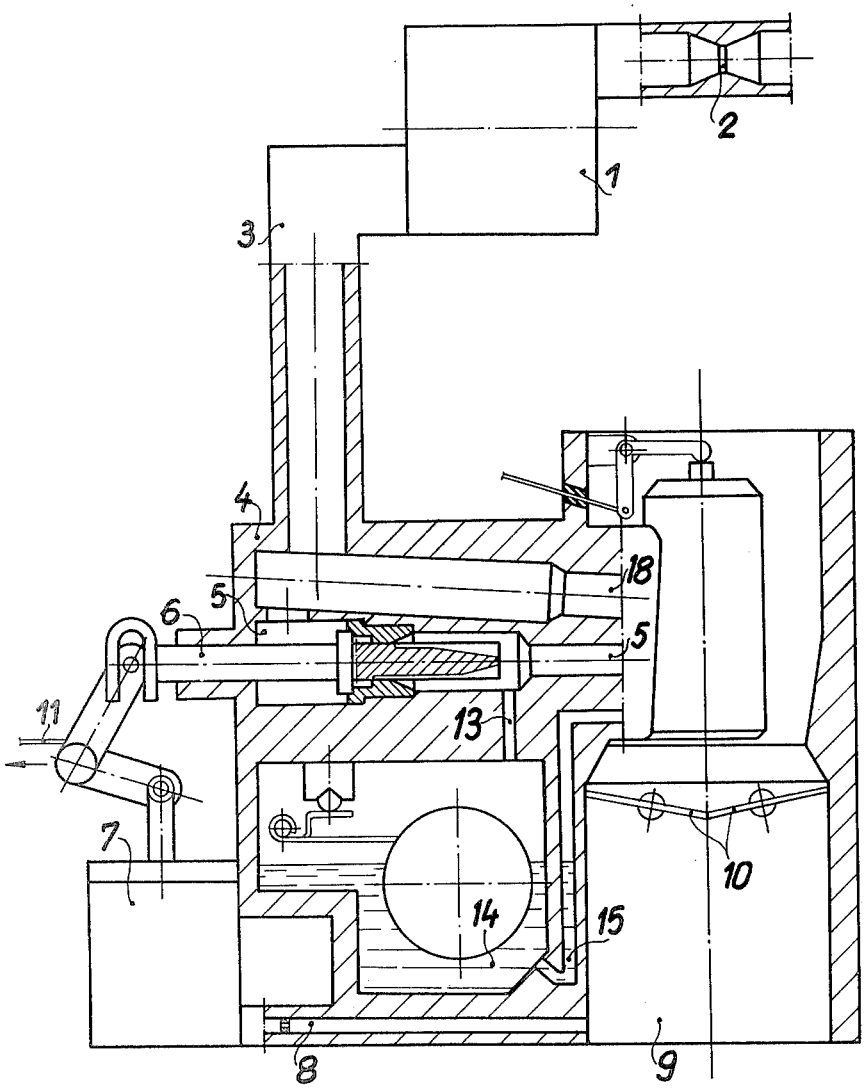
FIG. 1 is a sectional view of the apparatus of the invention.
Figure 3:
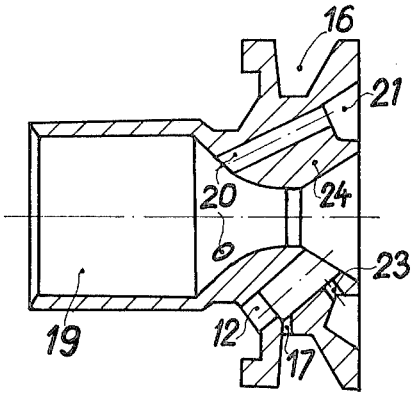
FIG. 3 is a sectional view of a set of nozzles.
Figure 2:
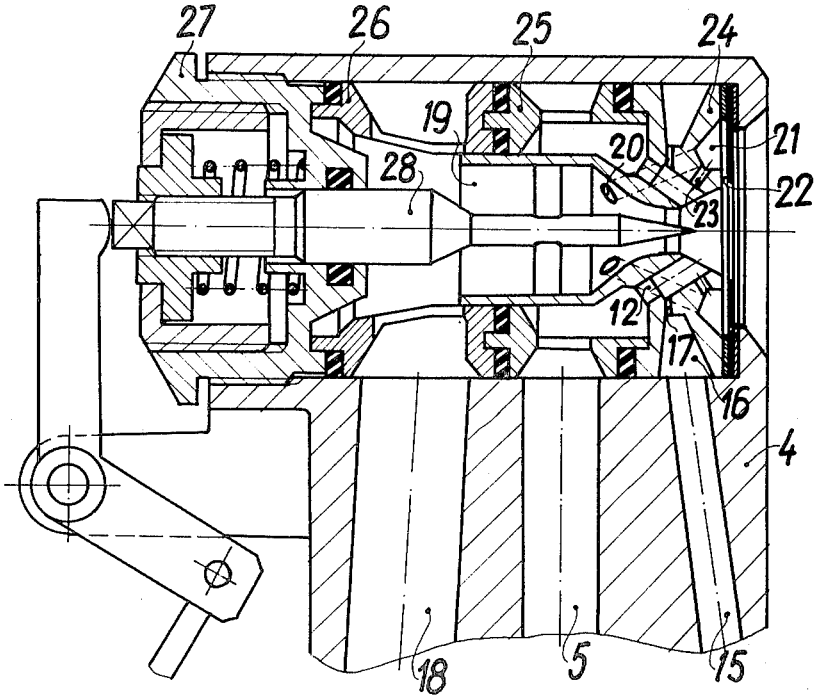
FIG. 2 is a sectional view of a multi-stage atomizer.

Seen in the drawing is a conventional source 1 with delivery suited to the requirements of the characteristics of the degree of the engine filling e.g. by means of throttling the flow using an orifice 2. Preferably a displacement pump driven by the engine crankshaft the source 1 is. The cylinder sliding surface is provided with suitable grooves directed from the outlet channel towards the upstream side of the blades within the range of angles corresponding to about ten percent of compression and produces compressed air with a uniform pressure without significant pulsations.

This compressed air is next supplied through a tube 3 directly to a device 4, wherein it is divided into two streams. One stream is supplied through tube 5 to a control valve 6, preferably in the form of a cylindrical slide in a cylindrical hole, said slide being operated by pneumatic actuator 7 connected with a tube 8 with a reduced portion to the suction tube 9 of the engine under the throttle valve 10, a well as with an accelerator pedal pull rod 11, in series with the throttle valve 10, in a manner depending upon engine load, atmospheric conditions and the degree of driver actuation of the accelerator pedal.

Compressed air whose pressure is controlled by means of control valve 6 is supplied through a narrowed portion of tube 5 to the side nozzles 12 for the preliminary atomization of a multi-stage atomizer and to channel 13, connected preferably upstream of the reduced portion of tube 5, and connected to the float chamber 14.

Fuel from the float chamber 14 flows through passage 15 to the chamber 16 of a multi-stage atomizer, wherefrom it is supplied through channels 17 to the side nozzles 12, and is sucked into the nozzles by compressed air and the fuel is strictly determined by the air pressure and is preliminarily atomized in the nozzles.

On the other hand, the second stream, which serves for the successive atomizations of the mixture, the preferable correction of discharge and prevention of secondary coagulation, supplies compressed air through tube 18 connected to the multi-stage atomizer above the central nozzle 19, wherefrom compressed air is supplied through holes 20 to the chamber 21 of an annular slot nozzle 22 and through holes 23, connecting the chamber 21 to the side nozzles 12 close to their outlet. Thus, the compressed air is supplied from the central nozzle 19 to the side nozzles 12 causing a preferable deflection of the mixture stream.

The multi-stage atomizer is located along the axis of the engine suction tube 9 on the upstream side of the throttle valve 10 and provides substantially, axial flow of the mixture and is fitted with the atomizer for engine idle consisting of a seat of the device 4 and a set of nozzles 24, representing together with the seat or a thin plate with a hole an annular slot nozzle 22, the nozzles being pressed above the sealing surface against the bottom of the seat through an insert 25 for the separation of the streams of compressed air and fuel by means of an annular sealing, top piece 26 and screwed-in head 27 for sealing and pressing the whole unit provided with a needle 28 fitted with suitable sealing, the needle being threadably and resiliently mounted.

The needle 28 serves for control of an effective cross-sectional area of the central nozzle 19 for the compensation of manufacturing tolerances or the degree of wear of the device by means of revolving as well as for momentary reduction of the effective cross section area of the central nozzle 19 by pressing against the needle 28, the pressure being mechanically controlled by means of a Bowden cable from the driver's compartment in order to facilitate the start of a cold engine.

We claim:

1. In a method for the preparation and control of an air-fuel mixture by fuel atomization using a high-velocity gas as an atomizing agent, said gas being at a pressure higher than ambient pressure and being present in an amount from a few percent to tens of percent of the air-fuel mixture supplied to the engine which continuously indues fuel, the amount of the induced fuel being proportional to the pressure of said gas, controlling said pressure at least by engine speed and load, so that the mixture ratio provides maximum effective pressure in the range of engine full loads, a minimum consumption of fuel and a minimun amount of toxic components in the exhaust gases in the range of engine partial loads, while concurrently continuously atomizing and homogenizing the fuel, introducing the mixture thus prepared into the engine air intake upstream of the throttle, mixing said mixture in the manifold with air induced by the engine for supplying the charge to the engine cylinders, and during coasting conditions when the braking effect of the engine is utilized and when the throttle is closed a negative pressure downstream of the throttle is utilized for cancelling the delivery of compressed gas to the multi-stage atomizer thereby interrupting the admission of fuel; said fuel being atomized and homogenized in multi-stage atomizer nozzles of fixed flow parameters, the atomization being effected by streams of gas under controlled pressure whereby induction of air and feed of fuel is effected simultaneously and under precise control conditions; during idling of the engine when the throttle is closed and when the demand for fuel is small and the degree of atomization is low the difference of pressure existing above and below the throttle is utilized to homogenize further the air-fuel mixture by causing the previously separated high-velocity streams of mixture to collide and expand; said multi-stage atomizer having stages in at least one of which said gas under controlled pressure is used for fuel atomization while in at least one other stage a gas of different parameters is used for additional fuel atomization; said throttle being formed with a symmetrical arrangement of throttle elements enabling substantially axial flow of mixture, the improvement wherein:

said gas is compressed air supplied without significant pressure pulsations and in a volumetrical amount proportional to the mass characteristic of the charge induced by the engine as a function of the parameters of atmospheric air, speed of the engine and suitable recesses in a sliding surface of a displacement pump, dividing said compressed air into at least two streams in a definite ratio, one of said streams serving for supplying and sucking the amount of fuel as determined by said flow parameters to effect atomization of the fuel, the second of said streams being subjected to momentary- and constant-corrections of flow parameters serving for successive atomization and homogenization of the mixture, for the desired correction of discharge as well as for preventing secondary coagulation of atomized fuel, said streams of compressed air being correlated so that change of flow parameters in one stream produces an equivalent change of flow parameters in the other stream, the control of the flow parameters in said first stream from engine start through idling and partial loads up to full loads of the engine being dependent on negative pressure downstream of the throttle, whereas enrichment of the mixture at engine full load is achieved by mechanically opening the valve through the accelerator pedal, said momentary correction increasing the flow parameters in said first stream and enriching the mixture, said constant change of the flow parameters in the second stream serving for compensation of manufacturing tolerances and degree of wear of apparatus elements.

2. A method as claimed in claim 1, wherein the multiplied streams of compressed air used for control of the air-fuel ratio ensure automatic pressure corrections in the course of said control depending upon the varying atmospheric conditions.

3. A method as claimed in claim 2, wherein the flow ratio between the open nozzles of said multi-stage atomizer supplying the first and second stream is from 10:90 to 30:70.

4. A method as claimed in claim 2, wherein said pressure pulsation of compressed air is eliminated by automatically opening suitable recesses provided in the sliding surface of said displacement pump.

5. A method as claimed in claim 2, wherein pulsation of the negative pressure controlling the valve is eliminated by throttling the flow in a passage connecting a pneumatic actuator with the engine intake manifold.

6. A method as claimed in claim 2, wherein said compressed air used for supplying the fuel from the float chamber is introduced on the upstream side of a reduced portion of a passage connecting the valve with the side nozzles of the multi-stage atomizer.

7. In an apparatus for the preparation and and control of an air-fuel mixture provided with a multistage atomizer installed in an air intake manifold of an engine upstream of the throttle thereof, a float chamber containing fuel connected to said multi-stage atomizer, means including a passage for supplying said multi-stage atomizer with a gas at a pressure higher than ambient pressure, said multi-stage atomizer including a diffuser at the end thereof opening towards the engine air intake manifold above the throttle whereat the mixture of fuel and gas is mixed with air induced by the engine to produce a charge for the engine cylinders, means for controlling the parameters of the gas supplied through the passage to the apparatus and a valve installed in said passage for correction of the flow parameters of the gas supplied to the multi-stage atomizer, said valve being pneumatically coupled with the air intake manifold downstream of the throttle to respond to negative pressure and being mechanically linked with the accelerator pedal in series with the throttle, said throttle comprising symmetrically opening elements having a shape cooperatively corresponding to the shape of the cross-section of the air intake manifold, said elements together forming an idling atomizer including, in series, a nozzle situated coaxially with the stream of flowing mixture, a port coaxially situated under said nozzle, and a staged nozzle for expanding the mixture, said multi-stage atomizer including a mechanical element whose flow parameters are constant, the fuel being induced and simultaneously being delivered at a continuous regulated pressure to side nozzles of said multi-stage atomizer from the float chamber, said float chamber being connected through a further passage to the first said passage, wherein selected stages of said multi-stage atomizer are connected with the first said passage of said compressed gas, and other stages connected with the further passage through which a gas of other properties may be delivered, the improvement comprising:

a source of said gas which is compressed air, said source including a displacement pump driven by the engine, said displacement pump having recessess in a sliding surface for obtaining volumetrical characteristics proportional to the mass characteristic of the charge induced to the engine and for preventing pressure pulsation, said displacement pump being connected through a passage directly to an apparatus where said passage is divided into at least two passages for the compressed air, said first passage including a valve, and after said valve said first passage having a reduced portion, said first passage being connected with the float chamber upstream of said reduced portion, said first passage being connected with side nozzles of the multi-stage atomizer downstream of said reduced portion, said valve in said first passage being operated by a pneumatic actuator, said pneumatic actuator being connected to the air intake manifold downstream of the throttle, said valve being operatively connected to the accelerator pedal in series with the throttle to be opened by said pedal, said second passage being connected to a central nozzle which communicates through ducts to a concentric slot nozzle, said second passage also being connected to ejection ports connected to the side nozzles near the outlets thereof, said multi-stage atomizer including rotatably shaped elements and seals dividing said first and second passages and means in said second passage for varying the cross-section of the central nozzle, the latter said means including a needle threadably and resiliently mounted and coupled to a control cable for facilitating start of a cold engine.

8. An apparatus as claimed in claim 7, wherein the multi-stage atomizer includes elements which are rotatably shaped.

9. An apparatus as claimed in claim 7, wherein said recesses in the cylindrical sliding surface of the displacement pump are directed towards the upstream side of the blades within an angular range and are inserted before the air inlet to the pump and between the air inlet and outlet.

10. An apparatus as claimed in claim 7, wherein the passage supplying said pneumatic actuator includes a portion for throttling the flow.

11. An apparatus as claimed in claim 7, wherein said float chamber is connected at one side to the source of fuel and at a second side to respective side nozzle for primary atomization of the multi-stage atomizer to supply multi-fuel mixture to the internal combustion engine, including fuels forming water emulsions or solutions.

* * * * *